United States Patent [19]

Kilmonis

[11] Patent Number: 4,544,158

[45] Date of Patent: Oct. 1, 1985

[54] APPARATUS FOR CARRYING AND PLAYING GAMES

[76] Inventor: Peter P. Kilmonis, 26 Carousel Dr., Millbury, Mass. 01527

[21] Appl. No.: 604,732

[22] Filed: Apr. 27, 1984

[51] Int. Cl.[4] ..... A63F 1/10

[52] U.S. Cl. ..... 273/150; 248/444.1

[58] Field of Search ..... 248/444.1, 450, 452; 273/148 A, 150, 269; 281/33; 434/88

[56] References Cited

U.S. PATENT DOCUMENTS

| | | | |
|---|---|---|---|
| 297,284 | 4/1884 | Mudgett | 248/452 |
| 2,257,005 | 9/1941 | Grosse | 434/88 X |
| 2,811,363 | 10/1957 | McDaniel | 273/150 |
| 3,023,005 | 2/1962 | Hochman | 273/148 A X |
| 4,213,520 | 7/1980 | Sarna | 281/33 X |
| 4,346,895 | 8/1982 | Brownlee | 273/150 |

*Primary Examiner*—Harland S. Skogquist
*Attorney, Agent, or Firm*—Charles R. Fay

[57] ABSTRACT

A combination game carrier and board comprising a wedge shaped core or base with means to permanently hold game cards under a transparent sheet which can be marked erasably and means to temporarily hold disposable cards in position for play. Means is also provided for carrying game parts and markers, etc.

12 Claims, 4 Drawing Figures

FIG. 1
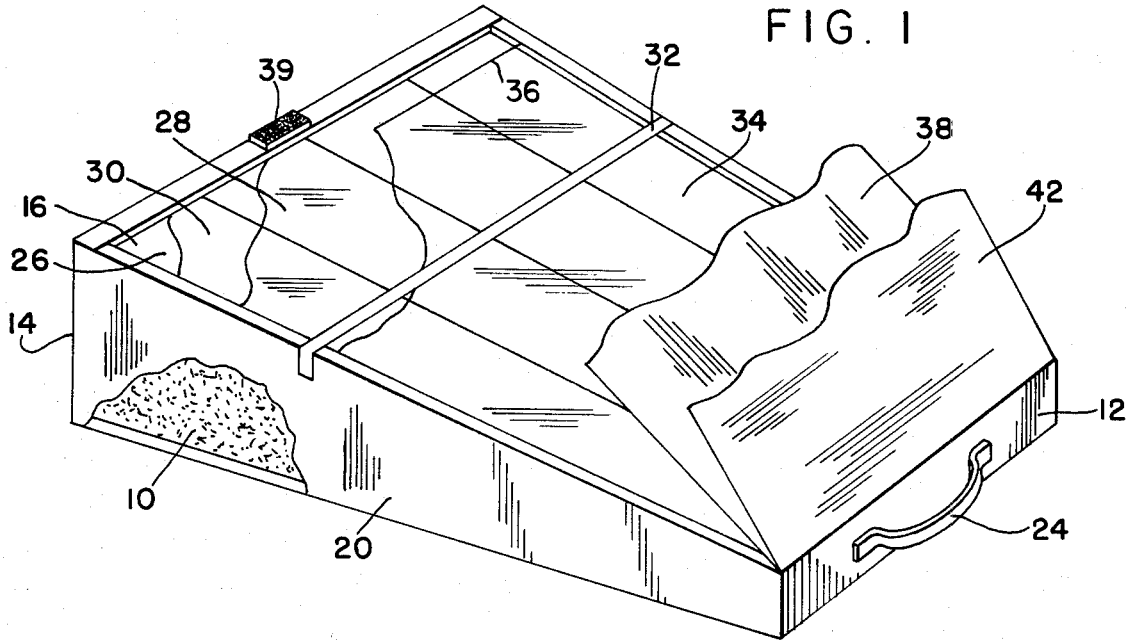
FIG. 3
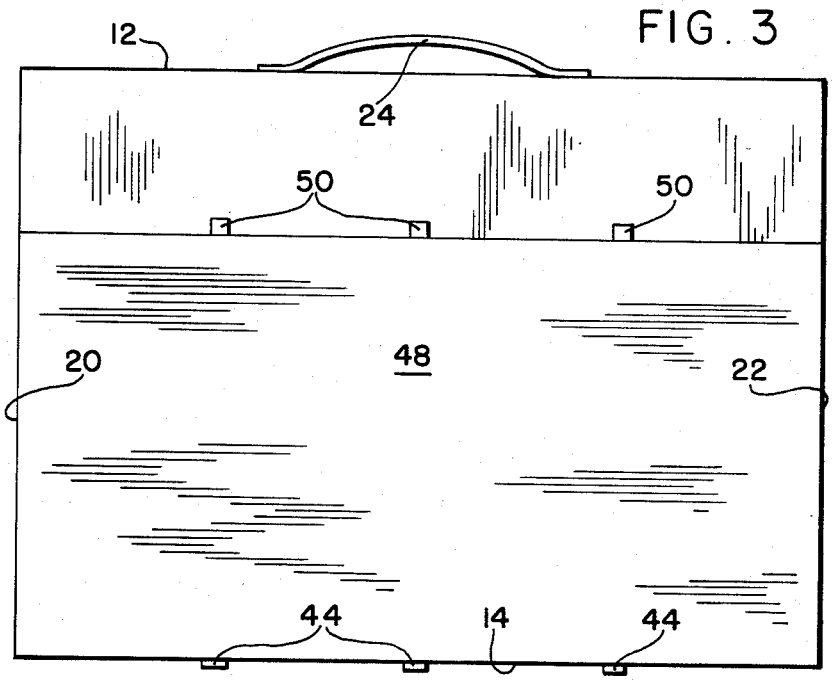
FIG. 2
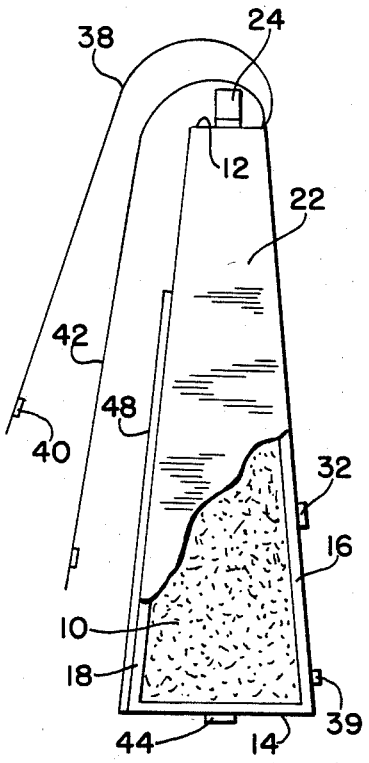
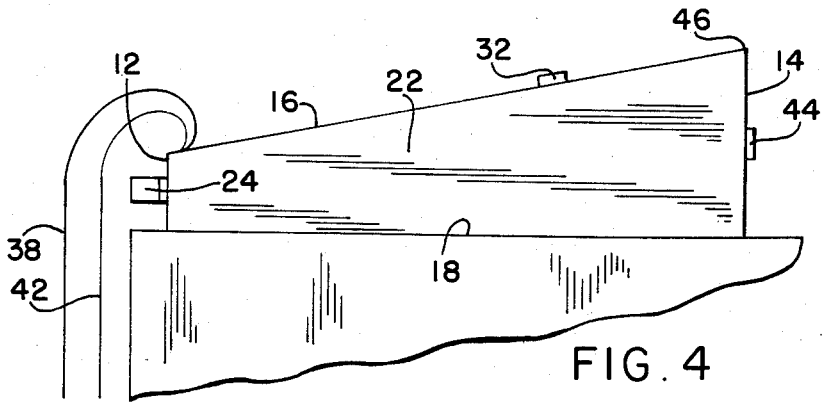
FIG. 4

APPARATUS FOR CARRYING AND PLAYING GAMES

FIELD OF THE INVENTION

Apparatus for transporting, storing, and playing games requiring the marking of cards; e.g. "Bingo".

BACKGROUND OF THE INVENTION

Although games such as Bingo and the like have long been known, no really satisfactory combined card holder and playing device that stores the cards, markers, et al has been provided, and it is the object of this invention to present a lightweight carrier for the game cards or pieces which also hold the latter while used in the game, making the game easier, more fun, and unitarily serving as a complete unit to store, carry, and play. Thus, the playing appurtenances are more visible, easier to play for handicapped, and provides an alternative to loose chips.

SUMMARY OF THE INVENTION

A wedge-shaped core of generally solid material, i.e., plastic foam of rigid or at least nearly rigid nature is covered at top and bottom surfaces and front and rear edges as well as at the ends, with any suitable materials. Naugahyde for instance provides a good strong covering for the top, bottom, front and rear, and the ends may be finished off with plastic end caps. This provides a one-piece, light-weight kind of desk. Flexible plastic sheet pockets can be provided and on the top surface there is a transparent co-extensive plastic sheet that confines a plurality of playing cards in more or less permanent relation. An erasible marking pen is provided so that numbers on the cards may be repeatedly indicated and easily erased for a series of games with the same cards. There is provided an overlay elastic to hold disposable game sheets, if desired, and a cover for this protects it and provides additional space for disposable sheets. An overall plastic sheet cover is permanently connected to, e.g. the narrower edge and temporarily connected to the wider edge for carrying and storage.

A handle is provided on the narow edge to carry the device and the wider edge is used to stand the apparatus for storage, etc.

BRIEF DESCRIPTION OF THE DRAWINGS

FIG. 1 is a front elevational view of the new game apparatus with parts broken away;

FIG. 2 is an end view showing the covers open;

FIG. 3 is a rear elevational view on a smaller scale; and

FIG. 4 is a view showing the apparatus down on a table and ready for use.

PREFERRED EMBODIMENT OF THE INVENTION

A wedge-shaped core preferably of foamed plastic or like light-weight rigid or semi-rigid material is indicated at 10. This core has a narrow front edge 12, a wider parallel rear edge 14, and top and bottom surfaces, 16 and 18. The core is completely covered as by flexible plastic sheeting at top and bottom surfaces and front and rear edges, and the ends 20 and 22 may be covered as desired but preferably by means of molded plastic end caps.

A handle 24 is provided at the narrow edge 12. The plastic opaque cover sheeting is indicated at 26, FIG. 1, and is permanent over the surface and edges of the case.

A transparent sheet of plastic as at 28 overlies the plastic cover sheet at the top surface, secured in any convenient way, and between the covering 26 and a transparent sheet 28 there are permanently placed several playing cards, as at 30, in general partially covering the sheeting 26. These cards may be Bingo cards of stiff permanent type. One kind conveniently used is the three high type which extend top to bottom or top surface 16. The transparent sheet 28 is of a type to take erasable marking so that the cards, held immobile by the transparent sheet, can be marked, as on the transparent sheet, and the marks are easily erased for the next game.

An elastomeric strip 32 extends from side to side of the top surface 16 and holds disposable Bingo card or like game cards, and once used, these are thrown away. If desired, a second plastic transparent sheet 34 having a gap at 36 to insert and remove cards may be provided. These cards can be used over and over but are removable.

A short cover of flexible opaque plastic 38 is secured along one of its edges at the narrow edge 12 and is otherwise free of the apparatus except for a temporary type fastener part at 40, to fasten to a corresponding fastener part 39 at the free edge of the plastic cover 38. as at 42 has fasteners at 44 on the wide edge 14, wrapping about the corner 46. A the bottom surface 14, an open top pocket 48 is provided with fasteners 50 to partially close it or, of course, a slide fastener could be used for the purpose.

It is seen that a very convenient light-weight combined carrier and game board is provided by this invention, and it makes playing easier and adds to the enjoyment of the game. The wedge shape is more like a desk, cutting down on glare and making the numbers on the cards easier to see. This invention is especially found to benefit players who lack coordination or who have a physical handicap. Chips, of course, are done away with entirely.

I claim:

1. A game apparatus comprising a core of light-weight, relatively rigid nature, said core including back and rear edges, top and bottom surfaces, and sides, the top and bottom surfaces being at an acute angle, these surfaces diverging from a relatively narrow front edge to a relatively wider rear edge, a flexible cover permanently secured to the front edge and temporarily securable to the rear edge to selectively cover or uncover the top surface, a flexible member on the top surface under the cover and secured to the front edge and extending to the rear edge, said flexible member providing a support for throw-away game sheets, a transparent sheet under the flexible member, means forming access to the space under the transparent sheet to insert game sheets thereunder so that they are visible through the sheet, means to support the game cards under the transparent sheet in close proximity thereto, an erasable marker to mark the transparent sheet to indicate items on the game cards thereunder.

2. The game apparatus of claim 1 including an elastomeric cord secured at its ends to the sides of the apparatus and extending across the transparent sheet o hold down game cards on top of the transparent sheet.

3. The garment apparatus of claim 1 wherein the transparent sheet is permanent.

4. The game apparatus of claim 1 wherein the core is of substantially rigid plastic foam.

5. The game apparatus of claim 1 wherein the flexible member is opaque.

6. The game apparatus of claim 1 wherein the rear edge serves as supporting bottom for the apparatus, and the front edge includes a handle.

7. The game apparatus of claim 1 wherein the transparent sheet is removable.

8. The apparatus of claim 7 including a second cover for the top surface, said second cover being secured at an edge thereof to the narrower edge, and of a size to cover the transparent sheet.

9. The appartus of claim 7 including a pocket substantially covering the bottom surface of the core.

10. The apparatus of claim 7 wherein the core is foam plastic.

11. The apparatus of claim 9 including coverings for the core including end caps and opaque sheets covering the top and bottom surfaces.

12. Apparatus for playing games of the Bingo type comprising a wedge shaped core of material permanently filling the core, said core having a wider edge and a narrower front edge, a permanently covered bottom surface, and a top surface, said top surface including a co-extensive transparent sheet for covering and holding playing cards, means to hold disposable cards on top of the sheet, and an opaque, flexible cover for the transparent sheet, means permanently securing said cover to one of the edges and temporarily securing it to the other edge.

* * * * *